US005188131A

United States Patent [19]

Toll

[11] Patent Number: 5,188,131

[45] Date of Patent: Feb. 23, 1993

[54] EYELASH MASCARA CASE AND APPLICATOR

[76] Inventor: Charlotte Toll, 312 S. Bedford Dr., Beverly Hills, Calif. 90212

[21] Appl. No.: 808,238

[22] Filed: Dec. 16, 1991

[51] Int. Cl.[5] ..... A45D 40/26

[52] U.S. Cl. ..... 132/218; 132/320

[58] Field of Search ..... 132/216, 218, 320; 401/126, 129

[56] References Cited

U.S. PATENT DOCUMENTS 3,764,221 10/1973 Solenghi ..... 401/129
4,165,755 8/1979 Cassai ..... 132/218
4,458,701 7/1984 Holland ..... 132/218

FOREIGN PATENT DOCUMENTS 0776191 1/1935 France ..... 132/218

*Primary Examiner*—John J. Wilson
*Assistant Examiner*—Jeffrey A. Smith
*Attorney, Agent, or Firm*—Burns, Doane, Swecker & Mathis

[57] ABSTRACT

An eyelash mascara applicator wand includes a first rod and a bristle-carrying second rod extending transversely relative to the first rod. The rods are joined at a location spaced transversely from both ends of the second rod. Bristles are located on both sides of that junction. The case includes a mascara-containing section of oblong cross section for receiving the second rod while the latter is oriented transversely relative to the first rod.

15 Claims, 1 Drawing Sheet

Fig. 1
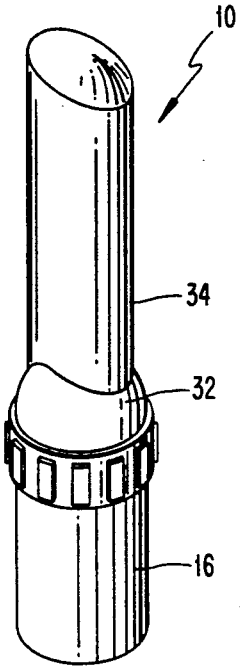
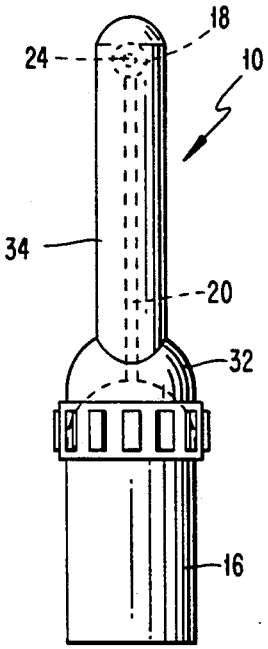
Fig. 2
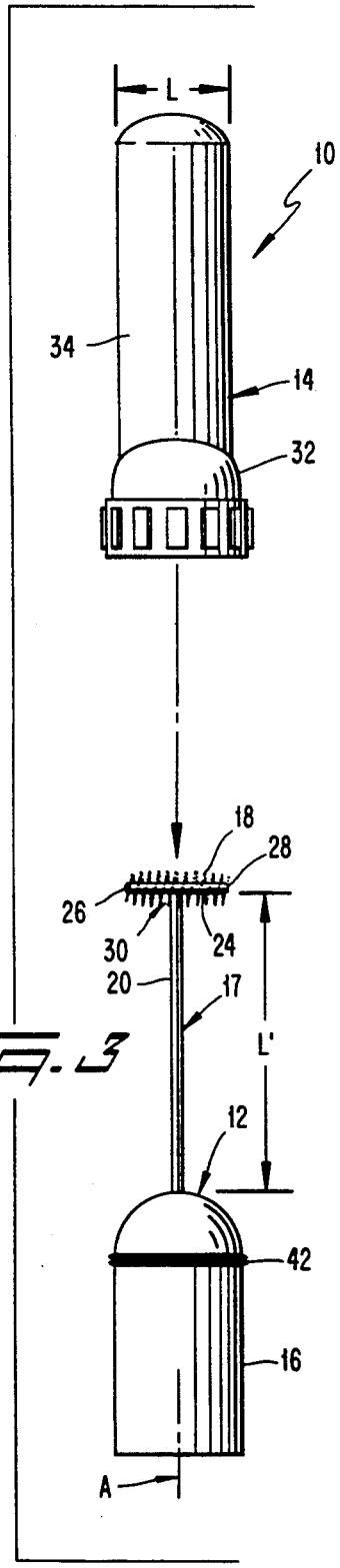
Fig. 3
Fig. 4
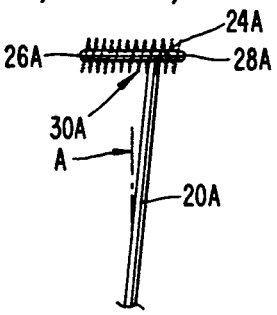
Fig. 5
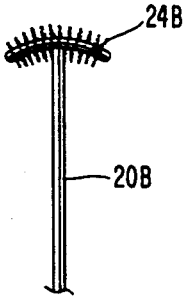

EYELASH MASCARA CASE AND APPLICATOR

BACKGROUND OF THE INVENTION

The present invention relates to an eyelash mascara applicator and mascara case therefor.

The application of mascara to eyelashes is typically performed by a wand with bristles disposed at one end thereof. The wand is used in conjunction with a cylindrical case or cover in which the mascara is contained in paste form. By inserting the bristle-end of the wand into the case, the bristles pick-up a supply of mascara. The mascara is transferred to the eyelashes by the user who grasps the wand at an end opposite the bristles and moves the bristles against the eyelashes.

One problem which has been encountered during the use of such applicators results from the fact that the end of the wand lies along the axis defined by the handle. Thus, as the handle and wand are moved toward the eye, there is presented a risk that the end of the wand will contact and injure the user's eye.

A mascara applicator purported to deal with that problem is disclosed in U.S. Pat. No. 4,165,755. In that applicator, the bristle end of the wand is mounted for pivotal movement relative to the handle-end, so that the bristle end can be oriented transversely relative to the axis of the handle. However, the bristles will be located on only one side of the wand, making it difficult to apply mascara to the eyelashes located at both ends of the eye, unless the user switches the wand from one hand to the other during the application step.

Also, such an applicator might be difficult to use, if the bristle-end becomes somewhat unstable due to the pivotal feature.

Furthermore, it is necessary to displace the bristle-end to a transverse relationship with the handle-end each time that the wand is removed from the case. This is inconvenient and also presents the possibility that the user's fingers might come in contact with the bristles and become soiled with mascara.

The above-described shortcomings are also characteristic of a mascara applicator disclosed in U.S. Pat. No. 4,428,388 wherein the bristle-end is displaced to a transverse position by bending a non-elastically flexible wand.

SUMMARY OF THE INVENTION

The present invention relates to an eyelash mascara applicator, and also to a combination of the applicator and a mascara-containing case therefor.

The applicator comprises a handle and a wand attached to the handle. The wand includes a first rod portion extending from the handle and a second rod portion extending transversely relative to the first rod portion. Bristles project outwardly around the outer circumference of the second rod portion. The second rod portion includes first and second opposite ends. The first rod portion intersects the second rod portion at a junction spaced from both of the first and second ends, so that bristles are situated on opposite sides of the junction. Preferably, the junction is located midway between opposite ends of the second rod portion. Alternatively, the junction could lie closer to one of the opposite ends than to the other.

The second rod portion could be straight, or arcuate-shaped such that a concave side thereof faces the handle. The bristles are preferably arranged in a helically pattern along the circumference of the second rod portion.

The mascara case comprises a mascara-containing section which is of oblong cross-sectional shape and sized to enable the second rod portion to be inserted therein while oriented transversely relative to the first rod portion.

BRIEF DESCRIPTION OF THE DRAWINGS

The objects and advantages of the invention will become apparent from the following detailed description of preferred embodiments thereof in connection with the accompanying drawings in which like numerals designate like elements, and in which:

FIG. 1 is a perspective view of a mascara case and applicator connected together;

FIG. 2 is a side elevational view of the case and applicator depicted in FIG. 1;

FIG. 3 is an exploded view of the case and applicator;

FIG. 4 is a fragmentary view of an alternative form of mascara applicator; and FIG. 5 is a fragmentary view of yet another embodiment of the mascara applicator.

DETAILED DESCRIPTION OF PREFERRED EMBODIMENTS OF THE INVENTION

A mascara applicator 10 comprises an applicator 12 and a case 14 into which the applicator can be inserted. The applicator 12 comprises a wand 17 and a handle 16. One end of the wand 17 is affixed to the handle 16, and the other end thereof carries bristles 18. The wand 17 includes a thin first rod 20 fixedly connected to a thin second rod 24 at a junction 30 spaced equally from both opposite ends 26, 28 of the rod 24.

The bristles 18 project outwardly around the entire circumference of the rod 24, preferably, in a conventional helical pattern along the length of the rod 24. Bristles are located on both sides of the junction 30.

Instead of being helically arranged, the bristles 18 could project radially outwardly from the rod 24 in a random fashion. Either way, however, the bristles will extend completely around the circumference of the rod 24.

The rods 20, 24 are formed of a relatively stiff material and are incapable of appreciable non-elastic deformation.

In use, a user grasps the handle 16 and holds the wand such that the rod 20 is oriented vertically, and the rod 24 is oriented horizontally so as to be parallel to a row of the user's eyelashes. The user then transfers mascara from the bristles 18 to the eyelashes by means of a vertical movement of the wand 17.

Since bristles 18 are located on opposite sides of the junction 30, it is relatively easy to apply mascara to both ends of the row of eyelashes by a mere twisting of the wrist. If, instead, bristles were located on only one side of the junction 30, it would be necessary for the user to reverse the wand in order to apply mascara to both ends of the eyelash row.

Since the rod 24 is not aligned with the axis of the handle portion, it would be difficult for the user to cause either end of the rod 24 to directly contact the eye. Hence, a safer operation is ensured.

Alternative forms of the wand are depicted in FIGS. 4 and 5. In FIG. 4, the junction 30A between the rods 20A and 24A is located closer to one end 28A of the rod 24A than to the opposite end 26A. Preferably in that case, the rod 20A is inclined relative to the longitudinal axis A of the handle.

In FIG. 5, the bristle-carrying rod 24B is of arcuate shape and oriented such that a concave side of the rod 24B faces the rod 20B.

The case 14 comprises a cylindrical base portion 32 and a mascara container portion 34. The latter holds a supply of mascara paste and is of generally oblong configuration, the length L of which being sufficiently long to enable the bristle-carrying rod 24 to be inserted therein.

That length L is preferably on the order of 0.75 to 0.10 inches. The overall length L' of the wand is on the order of 3.5 to 4.0 inches.

The case is removably attached to the applicator in any convenient manner, such as by means of a snap-fit onto an annular ridge 42 of the handle 16.

Although the present invention has been described in connection with preferred embodiments thereof, it will be appreciated by those skilled in the art that additions, modifications, substitutions, and deletions, not specifically described may be made without departing from the spirit and scope of the invention as defined in the appended claims.

What is claimed is:

1. An eyelash mascara applicator comprising a wand and a handle attached to said wand, said wand including a first rod portion extending from said handle, and a second rod portion extending transversely relative to said first rod portion, bristles projecting outwardly around the outer circumference of said second rod portion, said second rod portion including first and second opposite ends, said first rod portion intersecting said second rod portion at a junction spaced from both of said first and second ends, so that bristles are situated on opposite sides of said junction.

2. An eyelash mascara applicator according to claim 1, wherein said first and second rod portions are formed of a stiff material.

3. An eyelash mascara applicator according to claim 1, wherein said junction is located midway between said opposite ends.

4. An eyelash mascara applicator according to claim 1, wherein said junction lies closer to one of said opposite ends than to the other.

5. An eyelash mascara applicator according to claim 4, wherein said first rod portion extends at an angle relative to a longitudinal axis of said handle, said axis intersecting a midpoint of said second rod portion.

6. An eyelash mascara applicator according to claim 1, wherein said bristles are arranged in a helical pattern.

7. An eyelash mascara applicator according to claim 1, wherein said second rod portion is arcuate-shaped such that a concave side thereof faces said handle.

8. In combination, an eyelash mascara case and a mascara applicator insertable therein, said applicator comprising a wand and a handle attached to said wand, said wand including a first rod portion extending from said handle and a second rod portion extending transversely relative to said first rod portion, bristles projecting outwardly around the outer circumference of said second rod portion, said mascara case including a mascara-containing section of oblong cross section shaped to enable said second rod portion to be inserted therein while oriented transversely to said first rod portion, said second rod portion joining said first rod portion at a junction spaced from two opposite ends of said second rod portion so that bristles are situated on opposite sides of said junction.

9. A combination according to claim 8, wherein said junction is located midway between said opposite ends.

10. A combination according to claim 8, wherein said junction lies closer to one of said opposite ends than to the other.

11. A combination according to claim 10, wherein said first rod portion extends at an angle relative to a longitudinal axis of said handle, said axis intersecting a midpoint of said second rod portion.

12. A combination according to claim 8, wherein said first and second rod portions are formed of a stiff material.

13. A combination according to claim 8, wherein said bristles are arranged in a helical pattern.

14. A combination according to claim 8, wherein said second rod portion is arcuate-shaped such that a concave side thereof faces said first rod portion.

15. A combination according to claim 8, wherein said case includes a cylindrical base joined to said mascara-containing section, said base being connectible to said handle.

* * * * *